United States Patent [19]

Makimoto et al.

[11] Patent Number: 4,506,241

[45] Date of Patent: Mar. 19, 1985

[54] COAXIAL DIELECTRIC RESONATOR HAVING DIFFERENT IMPEDANCE PORTIONS AND METHOD OF MANUFACTURING THE SAME

[75] Inventors: Mitsuo Makimoto, Yokohama; Yukichi Aihara, Kawasaki; Sadahiko Yamashita, Sagamihara, all of Japan

[73] Assignee: Matsushita Electric Industrial Co., Ltd., Japan

[21] Appl. No.: 445,837

[22] Filed: Nov. 30, 1982

[30] Foreign Application Priority Data

Dec. 1, 1981 [JP] Japan ..... 56-193895

[51] Int. Cl.[3] ..... H01P 7/04; H01P 7/10

[52] U.S. Cl. ..... 333/222; 29/600; 333/206; 333/219

[58] Field of Search ..... 333/202, 206, 207, 212, 333/219, 222, 231, 232, 223, 34–35, 245, 248; 29/600

[56] References Cited

U.S. PATENT DOCUMENTS 2,859,418 11/1958 Vogelman ..... 333/34 X
3,872,412 3/1975 Seidel ..... 333/207 X
4,276,525 6/1981 Nishikawa et al. ..... 333/206
4,342,972 8/1982 Nishikawa et al. ..... 333/206
4,371,853 2/1983 Makimoto et al. ..... 333/219 X

FOREIGN PATENT DOCUMENTS 454572 10/1935 United Kingdom ..... 333/222

*Primary Examiner*—Marvin L. Nussbaum
*Attorney, Agent, or Firm*—Lowe, King, Price & Becker

[57] ABSTRACT

A coaxial dielectric resonator for VHF-UHF band comprises a generally cylindrical dielectric body having a thick portion, a thin portion and a stepped portion interposed between the thick and thin portion. The outer and inner surfaces of the dielectric body are respectively covered by outer and inner conductors. Thus the resonator can be regarded as a series circuit of two lines having different impedance from each other. The axial length of the thick and thin portions may be changed so as to change electrical characteristics. With the provision of thick and thin dielectric portions, the spurious resonance frequencies may be set to values other than integral multiples of the fundamental resonance frequency. The stepped portion may be rounded or replaced with a tapered portion so that impedance gradually changes at the stepped or tapered portion from the thick portion to the thin portion or vice versa.

13 Claims, 19 Drawing Figures

COAXIAL DIELECTRIC RESONATOR HAVING DIFFERENT IMPEDANCE PORTIONS AND METHOD OF MANUFACTURING THE SAME

BACKGROUND OF THE INVENTION

This invention relates generally to coaxial dielectric resonators for VHF and UHF bands, and more particularly the present invention relates to such resonators which are small in size, providing high Q.

With the recent tendency of miniaturizing radio equipment for VHF and/or UHF band, intensive research for miniaturizing various parts used in such equipment is being carried on. Especially, filters and resonators used in oscillators are required to have small size to minimize the entire size of radio equipment, such as radio receivers, transmitters or the like.

A well known small resonator for VHF-UHF band, having high Q (low loss) is a quarter wavelength coaxial resonator using TEM mode. This conventional resonator comprises coaxially arranged cylindrical outer and inner conductors and low-loss dielectric filled in the space between the outer and inner conductors so that wavelength reducing effect will be obtained. Namely, the length of such a resonator is shortened as expressed by $1/\sqrt{\epsilon r}$, wherein $\epsilon r$ is the specific inductive capacity of the dielectric use.

Although the above-mentioned conventional coaxial resonator has an advantage that it is simple in construction so that it can be readily manufactured, since the resonator has uniform impedance throughout its entire length, resonance points are not only at $f_o$ but also at $3f_o$ and $5f_o$ wherein $f_o$ is the fundamental resonance frequency. Therefore, when such a conventional resonator is used in an oscillator or as an output filter of an amplifier, harmonic components of three times and five times the fundamental frequency cannot be removed. In order to solve this problem, therefore, band-pass filters or low-pass filters which remove harmonic components often have to be used together with such a resonator.

SUMMARY OF THE INVENTION

The present invention has been developed in order to remove the above-described drawbacks inherent to the conventional coaxial dielectric resonators.

It is, therefore, an object of the present invention to provide a new and useful coaxial dielectric resonator for VHF-UHF band, which resonator does not have resonance points at three and five times the fundamental resonance frequency.

According to a feature of the present invention the diameter of at least one of outer and inner conductors is changed at a particular point so that the thickness of the dielectric held between the outer and inner conductors is changed.

In accordance with the present invention there is provided a coaxial dielectric resonator comprising: a generally hollow cylindrical dielectric having a thick portion, a thin portion, and a stepped portion interposed between the thick and thin portions; an outer conductor attached to the outer surface of the dielectric; an inner conductor attached to the inner surface of the dielectric; and a short-circuit plate attached to one end of the dielectric for making a short circuit between the outer and inner conductors.

In accordance with the present invention there is also provided a method of manufacturing a coaxial dielectric resonator, comprising the steps of: forming a generally hollow cylindrical dielectric having a thick portion, a thin portion, and a stepped portion interposed between the thick and thin portions; and forming outer and inner conductors on the outer and inner surfaces of the dielectric, and a short-circuit plate on one end of the dielectric for making a short circuit between the outer and inner conductors, the outer and inner conductors and the short-circuit plate being formed by electroless plating or baking.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Prior to describing the preferred embodiments of the present invention, the above-mentioned conventional coaxial dielectric resonator will be discussed with reference to FIGS. 1A and 1B for a better understanding of the present invention.

Figure 1A:
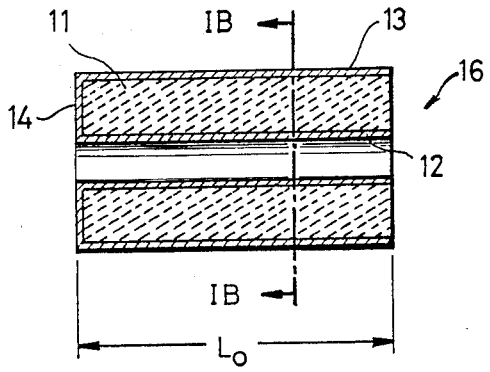
FIG. 1A PRIOR ART
FIG. 1A is a schematic cross-sectional front view of a conventional coaxial dielectric resonator.
Figure 1B:
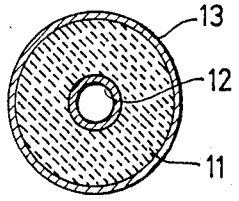
FIG. 1B PRIOR ART
FIG. 1B is a schematic cross-sectional side view of the conventional resonator of FIG. 1A taken along the line IB—IB.

FIGS. 1A and 1B show respectively cross-sectional front and side views of a conventional quarter wavelength resonator of the type having a dielectric. The resonator comprises cylindrical outer and inner conductors 13 and 12 which are coaxially arranged. A dielectric 11 is filled in the space between the outer and inner conductors 13 and 12. At one end, i.e. left end in FIG. 1, of the coaxial cylinders 13 and 12 is attached an annular short-circuit plate 14. This end with the short-circuit plate 14 will be referred to as a closed end. The reference 16 indicates an open end of the resonator.

The longitudinal or axial length $L_o$ of this resonator is expressed by:

$$L_o \approx \frac{\lambda_o}{4\sqrt{\epsilon r}}$$

wherein $\lambda_o = c/f_o$ (c is the velocity of light; $f_o$ is the resonance frequency)

The conventional coaxial dielectric resonator of FIGS. 1A and 1B, however, has resonance points not only at the fundamental resonance frequency $f_o$ but also at $3f_o$ and $5f_o$ as described hereinabove. As a result, the conventional resonator suffers from the aforementioned drawback.

Figure 2A:
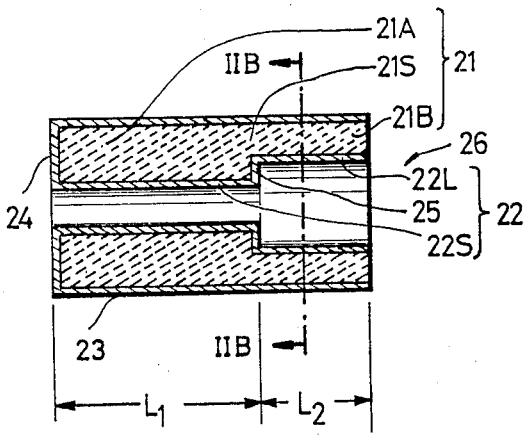
FIG. 2A is a schematic cross-sectional front view of a first embodiment of the coaxial dielectric resonator according to the present invention.
Figure 2B:
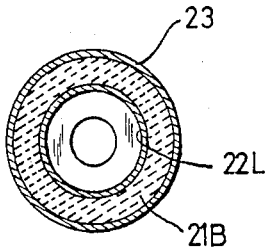
FIG. 2B is a schematic cross-sectional side view of the resonator of FIG. 2A taken along the line IIB—IIB.

Reference is now made to FIGS. 2A and 2B which show respectively cross-sectional front and side views of an embodiment of a quarter wavelength resonator according to the present invention. The resonator comprises outer and inner conductors 23 and 22 which are coaxially arranged. A dielectric 21 is filled or held in the space between the outer and inner conductors 23 and 22. At one end, i.e. left end in FIG. 2A, of the coaxial conductors 23 and 22 is attached an annular short-circuit plate 24. The reference 26 indicates an open end of the resonator, which is located at the other end. Although the outer conductor 23 is a cylindrical body in the same manner as in FIG. 1A, the inner conductor 22 has a stepped portion 25 at which the diameter thereof changes. Namely, the inner conductor has a small-diameter portion 22S and a large-diameter portion 22L connected at the stepped portion 25.

Since the space between the outer and inner conductors 23 and 22 is uniformly filled with the dielectric 21, the thickness of the dielectric 21 outside the large-diameter portion 22L is smaller than that of the dielectric 21 outside the small-diameter portion 22S. In other words, the dielectric 21, which is generally hollow cylindrical, comprises a thick portion 21A, a thin portion 21B and a stepped portion 21S interposed between the thick and thin portions 21A and 21B.

As the dielectric 21 may be used various kinds of materials such as ceramics. The specific inductive capacitance of the dielectric 21 may be between 10 and 100, and this value may be selected in accordance with a desired size and the resonance frequency of the resonator to be provided.

The coaxial dielectric resonator according to the present invention may be manufactured in substantially the same manner as the conventional resonators of this sort. Namely, the dielectric 21 is first formed by sintering a dielectric material, such as a ceramic. When forming the dielectric member, the dielectric material is formed to have a given shape, such as shown in FIGS. 2A and 2B. Then, the outer and inner conductors 23 and 22 as well as the short-circuit plate 24 are formed on the surfaces of the dielectric 21 by electroless plating copper or the like, or by a baking technique in which the dielectric 26 is put in a metal bath, and then the dielectric 21 is taken out of the bath to bake the same. The outer and inner conductors 23 and 22 as well as the short-circuit plate 24, therefore, are actually integrally formed by a thick film or layer of a metal deposited on the surfaces of the dielectric 21.

Now, it will be described how spurious frequencies, i.e. $3f_o$ and $5f_o$ ($f_o$ is the fundamental resonance frequency) are controlled with this structure of the resonator according to the present invenion. Assuming that the inner diameter of the outer conductor 23 is expressed in terms of $r_b$, and the outer diameter of the inner conductor 22 by $r_a$, the impedance $Z_o$ of the line constituting the resonator is given by:

$$Z_o = \frac{60}{\sqrt{\epsilon r}} \ln\left(\frac{r_b}{r_a}\right)$$

wherein $\epsilon_r$ is the relative dielectic constant (specific inductive capacitance) of the dielectric 26.

The above equation shows that the impedance $Z_o$ of the line can be varied by changing the ratio between $r_a$ and $r_b$.

In FIG. 2A, the length of the small-diameter portion 22S, which is close to the closed end, is expressed in terms of $L_1$, and the length of the large-diameter portion 22L, which is close to the open end 26, is expressed in terms of L2. Namely, the entire line constituting the resonator can be considered as a series circuit of two lines respectively having lengths L1 and L2. Assuming that the impedance of these lines are respectively expressed in terms of $Z_{o1}$ and $Z_{o2}$, the resonance condition of the resonator is given by:

$$\tan \beta L_1 \cdot \tan \beta L_2 = \tan \theta_1 \cdot \tan \theta_2 = Z_{o1}/Z_{o2}$$

wherein $\beta$ is a phase constant; and $$\theta_1 = \beta L_1; \text{ and } \theta_2 = \beta L_2 \text{ (in electrical length).}$$

Suppose $L_1 = L_2$, namely, $\theta_1 = \theta_2 = \theta$, for simplicity, the resonance condition in this case is given by:

$$\tan^2 \theta = Z_{o1}/Z_{o2} = K$$

wherein K is a ratio of impedance.

Since resonance frequency is in proportion to electrical length, the following equations are given.

$$\theta_o = \tan^{-1}\sqrt{K}$$

-continued $$f_{s1} = \frac{\theta_{s1}}{\theta_o} \cdot f_o = \frac{\pi - \theta_o}{\theta_o} \cdot f_o = \left( \frac{\pi}{\tan^{-1}\sqrt{K}} - 1 \right) \cdot f_o$$

$$f_{s2} = \frac{\theta_{s2}}{\theta_o} \cdot f_o = \frac{\pi + \theta_o}{\theta_o} \cdot f_o = \left( \frac{\pi}{\tan^{-1}\sqrt{K}} + 1 \right) \cdot f_o$$

wherein $f_o$ is the fundamental resonance frequency;

fs1 and fs2 are the lowest and second lowest spurious resonance frequencies;

$\theta_o$, $\theta_{s1}$ and $\theta_{s2}$ are electrical lengths respectively corresponding to $f_o$, fs1 and fs2.

Figure 6:
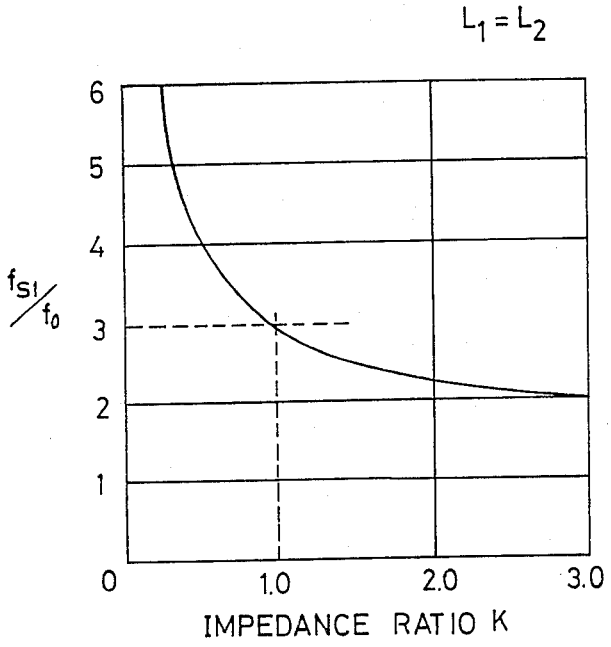
FIG. 6 is a graph showing the relationship between the impedance ratio and the lowest spurious resonance frequency obtained by the resonator according to the present invention.

From the above equations, it will be understood that the spurious resonance frequencies are given as functions of the impedance ratio K. FIG. 6 is a graphical representation showing the relationship between the impedance ratio K and the spurious resonance frequency $f_{s1}$. In FIG. 6, K=1 means a uniform impedance line, namely, it indicates the conventional resonator of FIG. 1.

As is apparent from the graph of FIG. 6, it is possible to set the lowest resonance frequency $f_{s1}$ at a value other than an integral multiple of $f_o$, and it is also possible to set the second lowest resonance frequency $f_{s2}$ at a value other than an integral multiple of $f_o$ in a similar manner. In other words, the spurious resonance frequencies may be located at other than an integral multiple of the fundamental resonance frequency $f_o$ by employing at least two lines having different impedance from each other. Accordingly, when the resonator according to the present invention is applied to an oscillator, output filter of an amplifier or the like, the resonator will satisfactorily suppress harmonic components.

FIGS. 3A to 5B show three different embodiments of the coaxial dielectric resonator according to the present invention, and these embodiments function in a similar manner to the first embodiment of FIGS. 2A and 2B.

Figure 3A:
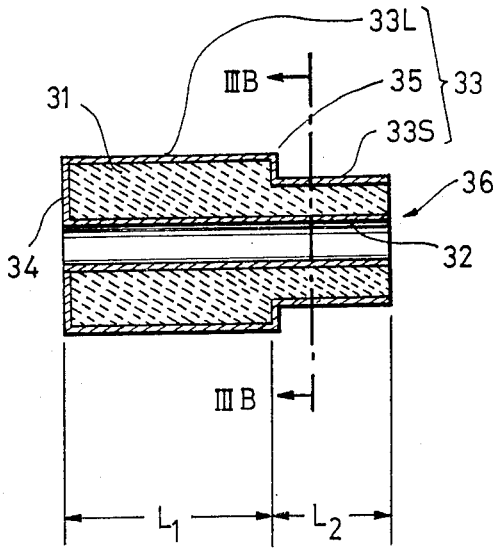
FIG. 3A is a schematic cross-sectional front view of a second embodiment of the coaxial dielectric resonator according to the present invention.
Figure 3B:
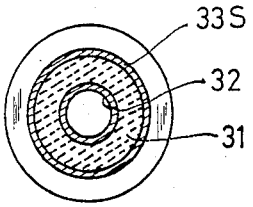
FIG. 3B is a schematic cross-sectional side view of the resonator of FIG. 3B taken along the line IIIB—IIIB.

The embodiment of FIGS. 3A and 3B differs from the first embodiment of FIGS. 2A and 2B in that the outer conductor 33 is stepped whereas the inner conductor 32 is simply cylindrical. Namely, the outer conductor 33 comprises a large-diameter portion 33L close to the closed end and a small-diameter portion 33S close to the open end 36. The reference 35 indicates a stepped portion or shoulder between the the large diameter portion 33L and the small diameter portion 33S.

In both the first and second embodiments of FIGS. 1A to 2B, the impedance ratio K is expressed by K>1, and therefore, the entire axial length $(L_1+L_2)$ of the resonator becomes $(L_1+L_2)<L_o$, wherein $L_o$ is the length of the conventional resonator of FIG. 1 having a constant impedance line if the same dielectric is used for both the conventional arrangement and the above-mentioned first and second embodiments. Namely, the entire length can be reduced compared to the conventional arrangement. However, as the length is reduced, unloaded Q deteriorates.

It will be described how the axial length can be reduced with the structure of the above-described first and second embodiments. When a quarter wavelength resonator having a resonance frequency of 1 GHz is constructed by coaxial cylindrical members as shown in FIGS. 1A and 1B, the axial length is 12.5 millimeters if barium titanate ($BaTi_9O_{20}$) is used as the dielectric, wherein relative dielectric constant of barium titanate is 36. According to the present invention when the impedance ratio K is selected to be 0.4, the axial length will be reduced to 8.8 millimeters under the same conditions as the above.

The stepped portion 21S of the dielectric between the thick and thin portions 21A and 21B may be provided to a desired location so that a desired value of the impedance ratio K will be obtained. As will be understood from the above-described equations, calculations are simplified when K is set to 1, and therefore designing of the coaxial dielectric resonator will be readily effected. Since K=1 means that the length $L_1$ equals L2, it is preferable to provide the stepped portion at a midway point between the closed end and the open end 26 in view of designing.

Figure 4A:
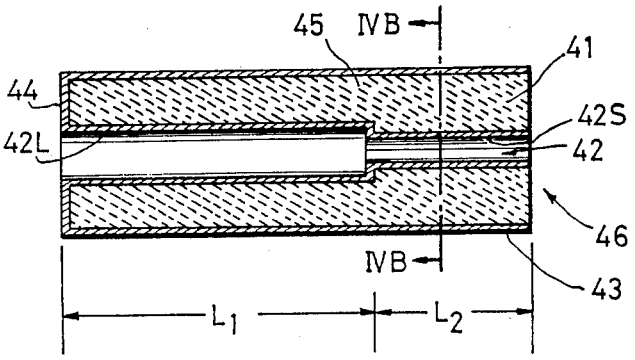
FIG. 4A is a schematic cross-sectional front view of a third embodiment of the coaxial dielectric resonator according to the present invention.
Figure 4B:
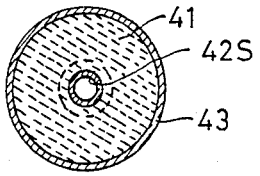
FIG. 4B is a schematic cross-sectional side view of the resonator of FIG. 4A taken along the line IVB—IVB.

FIGS. 4A and 4B show a third embodiment of the coaxial dielectric resonator according to the present invention. In this embodiment, the thickness of the dielectric 41 is made small at a portion close to the closed end. Namely, the inner conductor 42 comprises a large-diameter portion 42L close to the open end and a small-diameter portion 42S close to the open end 46. The reference 45 indicates a stepped portion or shoulder between the large diameter portion 42L and the small-diameter portion 42S.

Figure 5A:
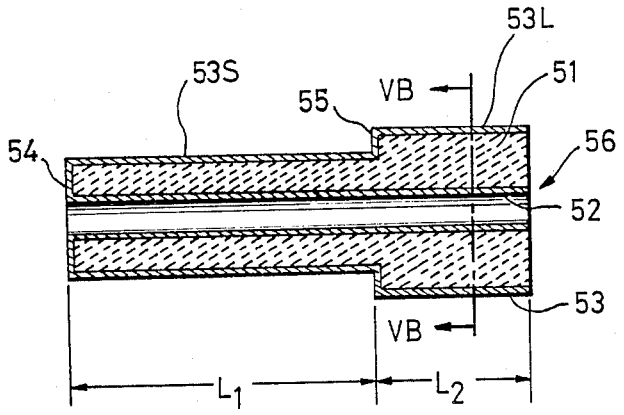
FIG. 5A is a schematic cross-sectional front view of a fourth embodiment of the coaxial dielectric resonator according to the present invention.
Figure 5B:
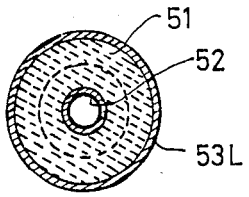
FIG. 5B is a schematic cross-sectional side view of the resonator of FIG. 5A taken along the line VB—VB.

FIGS. 5A and 5B show a fourth embodiment of the coaxial dielectric resonator according to the present invention. In this embodiment, the thickness of the dielectric 51 is also made small at a portion close to the closed end. Namely, the outer conductor 53 comprises a large-diameter portion 53L close to the open end and a small-diameter portion 53S close to the open end 56. The reference 55 indicates a stepped portion or shoulder between the the large diameter portion 53L and the small diameter portion 53S.

In the above-described fourth and fifth embodiments of FIGS. 4A to 5B, K<1. Therefore, the entire length $(L_1+L_2)$ of the resonator is $(L_1+L_2)>L_o$. This means that the entire length of the resonator becomes larger than that of the conventional arrangement. However, unloaded Q hardly changes from that of the conventional arrangement. Furthermore, these fourth and fifth embodiments have an advantage that dimensional accuracy is not required to be high. As a result, frequency control may be readily effected. In other words, a desired resonance frequency may be readily obtained.

Now various modifications or embodiment of the resonator according to the present invention will be further described with reference to FIGS. 7A to 10B. These embodiments basically differ from the above-described embodiments in that the stepped portion is replaced with a tapered portion so that the diameter of the outer or inner conductor changes gradually in the axial direction.

Figure 7A:
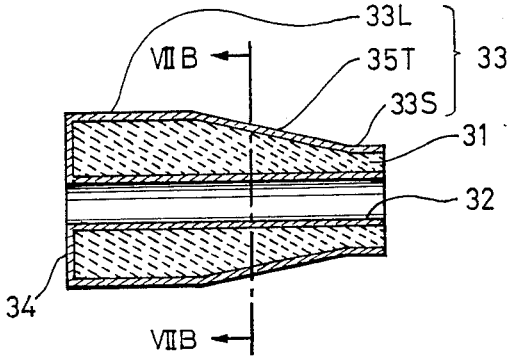
FIG. 7A is a schematic cross-sectional front view of a fifth embodiment of the coaxial dielectric resonator according to the present invention.
Figure 7B:
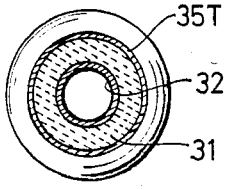
FIG. 7B is a schematic cross-sectional side view of the resonator of FIG. 7A taken along the line VIIB—VIIB.

FIGS. 7A and 7B show a fifth embodiment or modification of the resonator of FIGS. 3A and 3B. Namely, the stepped portion 35 of the outer conductor 33 of the second embodiment resonator of FIGS. 3A and 3B is substituted with a tapered portion 35T. Therefore, the thickness of the dielectric 31 gradually reduces along the tapered portion 35T in a direction from the closed end to the open end 36. Although it is possible to provide such a tapered portion 35 along the entire axial length of the resonator, it is preferable that the diameter around the closed end and the open end are respectively constant so that electromagnetic field distribution is uniform around both ends. Furthermore, such nontapered or constant diameter ends are advantageous when connecting or mounting the resonator to or on other devices.

Although it seems to be complex to provide such a tapered portion 35T, all that is required is to provide a tapered mold for forming the dielectric member 31 because the dielectric member 31 is usually formed by sintering a ceramic.

Figure 8A:
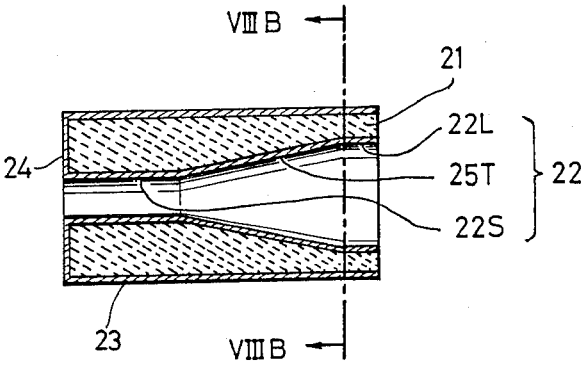
FIG. 8A is a schematic cross-sectional front view of a sixth embodiment of the coaxial dielectric resonator according to the present invention.
Figure 8B:
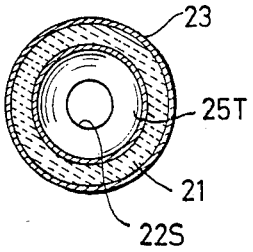
FIG. 8B is a schematic cross-sectional side view of the resonator of FIG. 8A taken along the line VIIIB—VIIIB.

FIGS. 8A and 8B show a sixth embodimemt which is a modification of the first embodiment resonator of FIGS. 2A and 2B. Namely, the inner conductor 22 comprises a tapered portion 25T between the small-diameter portion 22S and the large-diameter portion 22L.

In both the fifth and sixth embodiments of FIGS. 7A to 8B, the thickness of the diectric 21 or 31 reduces in the axial direction along the tapered portion 25T or 35T toward the open end 26 or 36 so that the impedance reduces accordingly.

Although all of the above-described resonators are of quarter wavelength, the present invention may be applied to a half wavelength resonator as will be described with reference to FIGS. 9A to 10B.

Figure 9B:
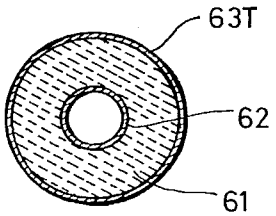
FIG. 9B is a schematic cross-sectional side view of the resonator of FIG. 9A taken along the line IXB—IXB.
Figure 9A:
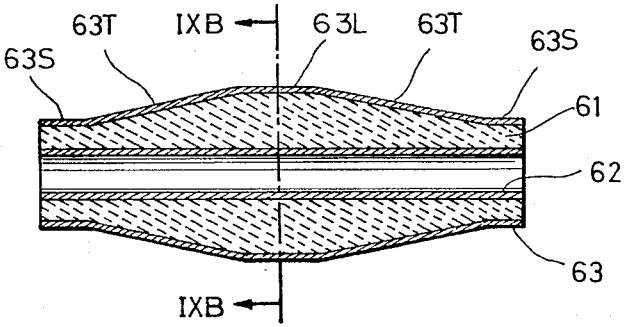
FIG. 9A is a schematic cross-sectional front view of a seventh embodiment of the coaxial dielectric resonator according to the present invention.

FIGS. 9A and 9B show a seventh embodiment resonator of half wavelength. In detail, the half wavelength resonator comprises outer and inner conductors 63 and 62, and a dielectric 61, no short-circuit plate is provided. In other words, both ends of the resonator are of open end. Although the inner conductor 62 is simply cylindrical, the outer conductor 63 comprises two small-diameter portions 63S at both ends, two tapered portions 63T respectively extending inward from the small-diameter portions 63S, and a large-diameter portion 63L interposed between the tapered portions 63T.

Figure 10B:
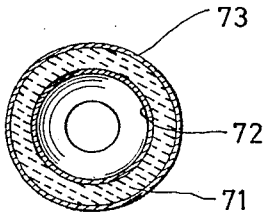
FIG. 10B is a schematic cross-sectional side view of the resonator of FIG. 10A taken along the line XB—XB.
Figure 10A:
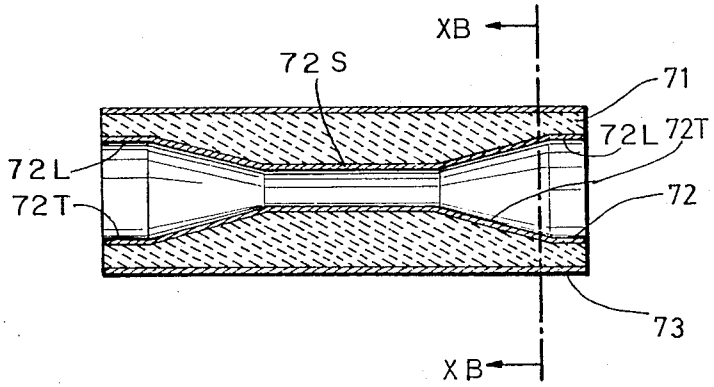
FIG. 10A is a schematic cross-sectional front view of an eighth embodiment of the coaxial dielectric resonator according to the present invention.

FIGS. 10A and 10B show an eighth embodiment or modification of the half wavelength resonator of FIGS. 9A and 9B. This resonator differs from the seventh embodiment in that the diameter of the inner conductor 72 changes while the diameter of the outer conductor is constant throughout its entire length so that the thickness of the dielectric 71 changes in the same manner as in the seventh embodiment. Two large-diameter portions, one small diameter portion, and two tapered portions are respectively indicated at 72L, 72S and 72T.

Although the provision of the above-mentioned tapered portion or portions in place of a stepped portion requires a tapered mold and may be more complex than a stepped mold, the tapered portion provides an advantage that the conductor is difficult to come off the dielectric surface. Furthermore, since the impedance does not change at the tapered portion as in the stepped portion, the degree of deterioration of Q can be effectively prevented.

In order to obtain these results, the above-mentioned tapered portion may be replaced with a rounded stepped portion. In other words, the shoulder portion or stepped portion 25, 35, 45 and 55 in FIGS. 2A, 3A, 4A and 5A shown to have right angle edges may be rounded so that the impedance varies at the stepped portion gradually.

The above-described embodiments are just examples of the present invention, and therefore, it will be apparent for those skilled in the art that many modifications and variations may be made without departing from the spirit of the present invention.

What is claimed is:

1. A coaxial dielectric resonators comprising:

(a) a generally hollow cylindrical dielectric having eliminating means for eliminating harmonics corresponding to integral multiples of a fundamental resonance frequency, said eliminating means having a thick dielectric portion, a thin dielectric portion, and a stepped dielectric portion interposed between said thick and thin dielectric portions, said thick dielectric portions having an impedance different from that of said thin dielectric portion so that an impedance ratio K therebetween is different from one to prevent resonance of said resonator at said harmonics;

(b) an outer conductor attached to the outer surface of said dielectric;

(c) an inner conductor attached to the inner surface of said dielectric; and (d) a short-circuit plate attached to one end of said dielectric for making a short circuit between said outer and inner conductors.

2. A coaxial dielectric resonator as claimed in claim 1 1, wherein said inner conductor has a large-diameter portion, a small-diameter portion, and a stepped portion interposed between said large-diameter portion and said small-diameter portion.

3. A coaxial dielectric resonator as claimed in claim 1, wherein said outer conductor has a large-diameter portion, a small-diameter portion, and a stepped portion interposed between said large-diameter portion and said small-diameter portion.

4. A coaxial dielectric resonator as claimed in claim 1, wherein said short-circuit plate is attached to the end of said thick portion of said dielectric.

5. A coaxial dielectric resonator as claimed in claim 1, wherein said short-circuit plate is attached to the end of said thin portion of said dielectric.

6. A coaxial dielectric resonator as claimed in claim 1, wherein said stepped portion is located at a midway point between both ends of said dielectric.

7. A method of manufacturing a coaxial dielectric resonator, comprising the steps of:

(a) forming a generally hollow cylindrical dielectric having a thick dielectric portion, a thin dielectric portion, and a stepped dielectric portion interposed between said thick and thin dielectric portions, (b) forming said thick dielectric portion to have an impedance different from that of said thin dielectric portion so that an impedance ratio K therebetween is different from one to prevent resonance of said resonator at harmonics corresponding to integral multiples of a fundamental resonance frequency; and (c) forming outer and inner conductors on the outer and inner surfaces of said dielectric, and a short-circuit plate on one end of said dielectric for making a short circuit between said outer and inner conductors, said outer and inner conductors and said short-circuit plate being formed by electroless plating or baking.

8. A coaxial dielectric resonator as claimed in claim 1, wherein said impedance ratio K is set to a value defined by one of the following three relationships:

K substantially equals 0.4

$$0.6 < K < 0.8$$

$$1.2 < K < 1.4.$$

9. A coaxial dielectric resonator as claimed in claim 1, wherein said impedance ratio K is set to a value other than 0.23 or less, 0.33, 0.52 and 3.00 or more.

10. A coaxial dielectric resonator as claimed in claim 7, wherein said impedance ratio K is set to a value defined by one of the following three relationships:

K substantially equals 0.4

$$0.6 < K < 0.8$$

$$1.2 < K < 1.4.$$

11. A coaxial dielectric resonator as claimed in claim 7, wherein said impedance ratio K is set to a value other than 0.23 or less, 0.33, 0.52 and 3.00 or more.

12. A method for eliminating harmonics corresponding to integral multiples of a fundamental resonance frqeuency in a structure including a generally hollow cylindrical dielectric comprising the steps of:

providing to said dielectric first and second portions having impedances different from one another to obtain an impedance ratio therebetween, said impedance ratio different from one;

providing a thick dielectric portion to said first portion;

providing a thin dielectric portion to said second portion;

interposing a stepped dielectric portion between said first and second portions;

attaching an outer conductor to an outer surface of said dielectric;

attaching an inner conductor to an inner surface of said dielectric;

attaching a short-circuit plate to one end of said dielectric to provide a short-circuit between said outer and inner conductors;

eliminating from a signal passed through said structure harmonics at integer multiples of a resonance frequency of said structure.

13. A method for eliminating harmonics as recited in claim 12 wherein said eliminating step comprises the further step of passing a signal along inner and outer conductors of a resonator having said thin, thick and stepped dielectric portions, said inner and outer conductors, and said short-circuit plate.

* * * * *

US004506241B1

REEXAMINATION CERTIFICATE (1967th)

United States Patent [19]

Makimoto et al.

[11] B1 4,506,241

[45] Certificate Issued Apr. 6, 1993

[54] COAXIAL DIELECTRIC RESONATOR HAVING DIFFERENT IMPEDANCE PORTIONS AND METHOD OF MANUFACTURING THE SAME

[75] Inventors: Mitsuo Makimoto, Yokohama; Yukichi Aihara, Kawasaki; Sadahiko Yamashita, Sagamihara, all of Japan

[73] Assignee: Matsushita Electric Industrial Company, Limited, Kadoma, Japan

Reexamination Request:
No. 90/002,434, Sep. 9, 1991

Reexamination Certificate for:

| | |
|---|---|
| Patent No.: | 4,506,241 |
| Issued: | Mar. 19, 1985 |
| Appl. No.: | 445,837 |
| Filed: | Nov. 30, 1982 |

[30] Foreign Application Priority Data

Dec. 1, 1981 [JP] Japan ..... 56-193895

[51] Int. Cl.[5] ..... H01P 7/04

[52] U.S. Cl. ..... 333/222; 29/600; 333/206; 333/219

[56] References Cited

U.S. PATENT DOCUMENTS

| | | | |
|---|---|---|---|
| 2,838,736 | 6/1958 | Foster . | |
| 2,859,418 | 11/1958 | Vogelman | 333/34 X |
| 3,505,618 | 4/1970 | McKee . | |
| 3,872,412 | 3/1975 | Seidel | 333/207 X |
| 4,276,525 | 6/1981 | Nishikawa et al. | 333/206 |
| 4,342,972 | 8/1982 | Nishikawa et al. | 333/206 |
| 4,371,853 | 2/1983 | Makimoto et al. | 333/219 X |

FOREIGN PATENT DOCUMENTS

| | | | |
|---|---|---|---|
| 52-96850 | 8/1977 | Japan . | |
| 454572 | 10/1935 | United Kingdom | 333/222 |

OTHER PUBLICATIONS

Moreno, *Microwave Transmission Design Data*, Dover Publ., N.Y., 1948, pp. 62 & 97.

"Band Pass Filters Using Stepped Impedance Resonators" by Makimoto and Yamashita, Proceedings of IEEE, vol. 67, No. 1, Jan. 1979.

"Miniaturized Band Pass Filters Using Half Wave Dielectric Resonators with Improved Spurious Response" Wakino, Nishikawa, Matsumoto and Ishikawa; 1978 IEEE MTT-S Digest, pp. 230 to 232.

*Primary Examiner*—Paul Gensler

[57] ABSTRACT

A coaxial dielectric resonator for VHF-UHF band comprises a generally cylindrical dielectric body having a thick portion, a thin portion and a stepped portion interposed between the thick and thin portion. The outer and inner surfaces of the dielectric body are respectively covered by outer and inner conductors. Thus the resonator can be regarded as a series circuit of two lines having different impedance from each other. The axial length of the thick and thin portions may be changed so as to change electrical characteristics. With the provision of thick and thin dielectric portions, the spurious resonance frequencies may be set to values other than integral multiples of the fundamental resonance frequency. The stepped portion may be rounded or replaced with a tapered portion so that impedance gradually changes at the stepped or tapered portion from the thick portion to the thin portion or vice versa.

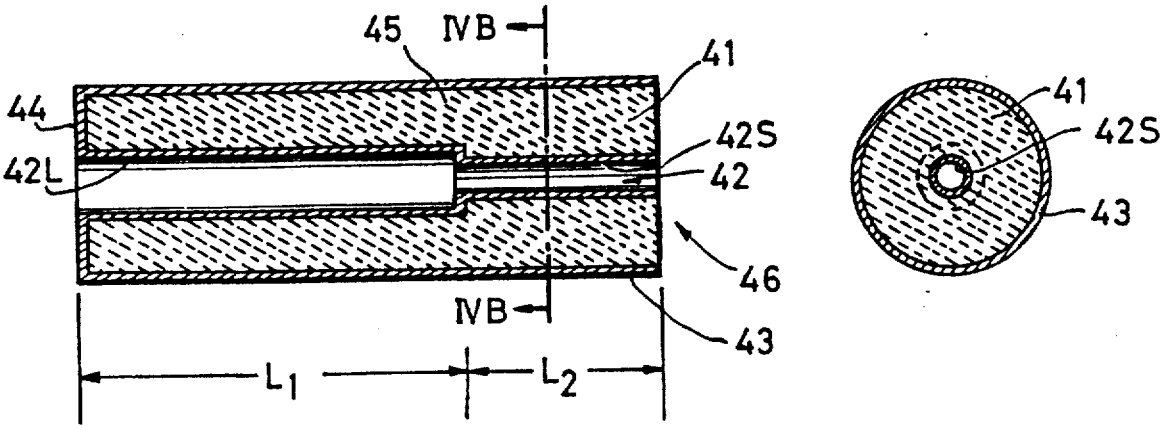

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-4, 6 and 8-13 are cancelled.

Claims 5 and 7 are determined to be patentable as amended.

New claim 14 is added and determined to be patentable.

5. A coaxial dielectric resonator [as claimed in claim 1] *comprising:*

(*a*) *a generally hollow cylindrical dielectric material having first and second ends, said cylindrical dielectric material having eliminating means for eliminating harmonics corresponding to integral multiples of a fundamental resonance frequency, said eliminating means having a thick portion of dielectric material, a thin portion of dielectric material, and a stepped portion of dielectric material interposed between said thick and thin portions of dielectric material, said thick portion of dielectric material having an impedance different from that of said thin portion of dielectric material so that an impedance ratio K of said impedance of said thin portion of dielectric material to said impedance of said thick portion of dielectric material is less than one to prevent resonance of said resonator at said harmonics;*

(*b*) *an outer conductor attached to the outer surface of said dielectric material;*

(*c*) *an inner conductor attached to the inner surface of said dielectric material; and*

(*d*) *a short-circuit plate attached only to one of said first and second ends of said cylindrical dielectric material thereby closing said one end and making a short circuit between said outer and inner conductors, the other end of said cylindrical dielectric material being open*, wherein said short-circuit plate is attached *only* to the end of said thin portion of [said] dielectric *material.*

7. A method of manufacturing a coaxial dielectric resonator, comprising the steps of:

(a) forming a generally hollow cylindrical dielectric *material having first and second ends and further* having a thick [dielectric] portion *of dielectric material*, a thin [dielectric] portion *of dielectric material*, and a stepped [dielectric] portion *of dielectric material* interposed between said thick and thin [dielectric] portions[,]*;*

(b) forming said thick [dielectric] portion *of dielectric material* to have an impedance different from that of said thin [dielectric] portion *of dielectric material* so that an impedance ratio K [therebetween] *of said impedance of said thin portion of dielectric material to said impedance of said thick portion of dielectric material* is [different from] *less than* one to prevent resonance of said resonator at harmonics corresponding to integral multiples of a fundamental resonance frequency; and (c) forming outer and inner conductors on the outer and inner surfaces of said dielectric *material*, and *forming* a short-circuit plate on *only* one of said *first and second ends of said cylindrical* dielectric [for] *material thereby closing said one end and* making a short circuit between said outer and inner conductors, *the other end of said cylindrical dielectric material being open*, said outer and inner conductors and said short-circuit plate being formed by electroless plating or baking.

*14. A coaxial dielectric resonator comprising:*

(*a*) *a generally hollow cylindrical dielectric material having first and second ends, said cylindrical dielectric material having eliminating means for eliminating harmonics corresponding to integral multiples of a fundamental resonance frequency, said eliminating means having a thick portion of dielectric material, a thin portion of dielectric material, and a tapered portion of dielectric material interposed between said thick and thin portions of dielectric material, said thick portion of dielectric material having an impedance different from that of said thin portion of dielectric material so that an impedance ratio K of said impedance of said thick portion of dielectric material to said impedance of said thin portion of dielectric material is greater than one to prevent resonance of said resonator at said harmonics;*

(*b*) *an outer conductor attached to the outer surface of said dielectric material;*

(*c*) *an inner conductor attached to the inner surface of said dielectric material; and*

(*d*) *a short-circuit plate attached only to one of said first and second ends of said cylindrical dielectric material thereby closing said one end and making a short circuit between said outer and inner conductors, the other end of said cylindrical dielectric material being open, wherein said short-circuit plate is attached only to the end of said thick portion of dielectric material.*

* * * * *